US010253488B2

(12) United States Patent
Sikirov

(10) Patent No.: US 10,253,488 B2
(45) Date of Patent: Apr. 9, 2019

(54) COMBINED TOILET DEVICE

(71) Applicant: MEDLOGIC LTD., Ramat Gan (IL)

(72) Inventor: Berko Sikirov, Ramat Gan (IL)

(73) Assignee: Berko Sikirov, Ramat Gan (IL)

( * ) Notice: Subject to any disclaimer, the term of this patent is extended or adjusted under 35 U.S.C. 154(b) by 0 days.

(21) Appl. No.: 14/649,863

(22) PCT Filed: Dec. 2, 2013

(86) PCT No.: PCT/IL2013/050987
§ 371 (c)(1),
(2) Date: Jun. 4, 2015

(87) PCT Pub. No.: WO2014/087399
PCT Pub. Date: Jun. 12, 2014

(65) Prior Publication Data

US 2015/0322658 A1 Nov. 12, 2015

(30) Foreign Application Priority Data

Dec. 6, 2012 (IL) ..... 223505

(51) Int. Cl.
*E03D 9/00* (2006.01)
*E03D 11/02* (2006.01)
(Continued)

(52) U.S. Cl.
CPC ..... *E03D 11/025* (2013.01); *A47K 17/028* (2013.01); *E03D 11/04* (2013.01); *E03D 11/13* (2013.01); *E03D 9/00* (2013.01)

(58) Field of Classification Search
CPC ..... E03D 5/10
(Continued)

(56) References Cited

U.S. PATENT DOCUMENTS 923,344 A * 6/1909 Faller ..... A47D 1/02 297/37
1,163,263 A * 12/1915 Rudduck ..... G09B 19/0076 297/154

(Continued)

FOREIGN PATENT DOCUMENTS

WO 2003/074799 A1 9/2003

OTHER PUBLICATIONS

International Search Report in co-pending application No. PCT/IL2013/050987, dated Mar. 13, 2014.

*Primary Examiner* — Lori Baker
(74) *Attorney, Agent, or Firm* — Fox Rothschild LLP

(57) ABSTRACT

A combined toilet device comprises a platform for supporting a user in a squatting defecation position. The platform is mountable over a toilet bowl wherein the opening in the platform is aligned with the opening in the toilet bowl. The device includes a urinal pan to prevent dispersion of the urine. The frame of the urinal pan is formed by a pipe arc having long and short parts which are continued one into other and are in different planes with 90 grade between them. The urinal pan walls are comprised of flexible material framed with the pipe arc. Pipe arc serves for converting of the urinal pan into functional or nonfunctional position. The urinal pan is covered in a nonfunctional position by a cover which is formed from two leafs attached pivotally to the platform at either side of the pan. In a functional position the leafs of the cover fix the urinal pan at any desirable point.

7 Claims, 5 Drawing Sheets

(51) Int. Cl.
*E03D 11/04* (2006.01)
*A47K 17/02* (2006.01)
*E03D 11/13* (2006.01)

(58) Field of Classification Search
USPC ..... 4/300–442
See application file for complete search history.

(56) References Cited

U.S. PATENT DOCUMENTS 1,482,073 A * 1/1924 Ferdinand ..... A47K 13/00 108/132
4,117,555 A * 10/1978 Dennis ..... A01K 1/011 119/163
4,271,544 A * 6/1981 Hammond ..... A01K 1/0121 119/162
4,819,277 A * 4/1989 Sikirov ..... A47K 13/24 4/239
4,979,469 A * 12/1990 Clark ..... A01K 1/0107 119/161
5,809,583 A * 9/1998 Pucciani ..... A47K 17/028 4/254
6,256,800 B1 * 7/2001 Isbit ..... A47K 17/028 4/254
6,782,565 B2 * 8/2004 Hinton ..... A47K 13/005 4/239
6,889,392 B1 * 5/2005 Karnopp ..... A47K 17/00 4/239
7,146,655 B2 * 12/2006 Karnopp ..... A47K 17/00 4/239
7,814,581 B1 * 10/2010 Willner ..... A47K 17/02 297/423.41
7,962,973 B2 6/2011 Sikirov
7,987,529 B1 * 8/2011 Wise ..... A47K 13/24 4/254
8,317,268 B2 * 11/2012 Alkhattaf ..... A47C 16/02 297/423.39
8,978,171 B1 * 3/2015 Wise ..... A47K 13/24 4/254
9,307,879 B2 * 4/2016 Fagre ..... A47K 17/028
2008/0109952 A1 * 5/2008 Sikirov ..... A47K 17/00 4/254
2016/0051101 A1 * 2/2016 Long ..... E03D 13/005 4/251.1

* cited by examiner

COMBINED TOILET DEVICE

RELATED APPLICATIONS

This application is a U.S. National Stage of International Application No. PCT/IL2013/050987, filed on 2 Dec. 2013 and published on 12 Jun. 2014, as WO 2014/087399 A1, which claims the benefit of priority to Israeli Patent Application No. IL 223505, filed on 6 Dec. 2012.

BACKGROUND OF THE INVENTION

Squatting toilet device is the only natural defecation posture for the human being and accordingly to recent research it prevents many medical problems. However the main hygienic problem of existing squatting devices is the soiling by the urine of the platform as well as user's feet and clothes. Recently was invented squatting device which includes an urinal (U.S. Pat. No. 7,962,973 B2) pan to resolve the above problem. The significant drawback of the cited patent is connected with converting of the pan from nonfunctional to functional position and vice versa. In the above US Patent it is done by complex rotation movement by means of the cover of the pan. Such rotation movement is to complex and some person will be unable to perform it. Accordingly a new squatting device was invented.

SUMMARY OF THE INVENTION

A combined toilet device for defecation in a natural squatting defecation posture and having a platform to support a user in the squatting defecation posture over its opening aligned with the toilet bowl, said device comprises an urinal pan to prevent urine dispensing, the frame of the said urinal pan is formed by a pipe arc having a long and short parts, said pipe arc, wherein the parts of pipe arc continues one into another, said pipe arc, wherein long and short parts are at different planes with 90 grade between them, short and long parts of the said pipe arc serves for converting of the urinal pan to functional or nonfunctional position, said pipe arc wherein a flexible material is attached continuously to the said pipe arc forming walls of urinal bag (namely of the urinal pan) opened in the direction of a squatting men, said flexible material is a silicone or rubber or similar materials permitting to prepare a urinal bag of desirable shape by appropriate mold, said pipe arc wherein its free ends of the rear part is attached pivotally to the platform at the area of front part of the opening, said long and short parts of the urinal pan are in different planes with 90 grade between them thus forming a depth in the urinal bag what prevent the urine stream rebounding on the user, said squatting device includes a cover of urinal pan formed from two plastic leafs which cover the urinal pan in a nonfunctional position, said plastic leaves are attached pivotally to the platform one at either side of the pan, said plastic leafs are attached to the platform by axles which contains springs.

DETAILED DESCRIPTION OF THE INVENTION

Figure 1:
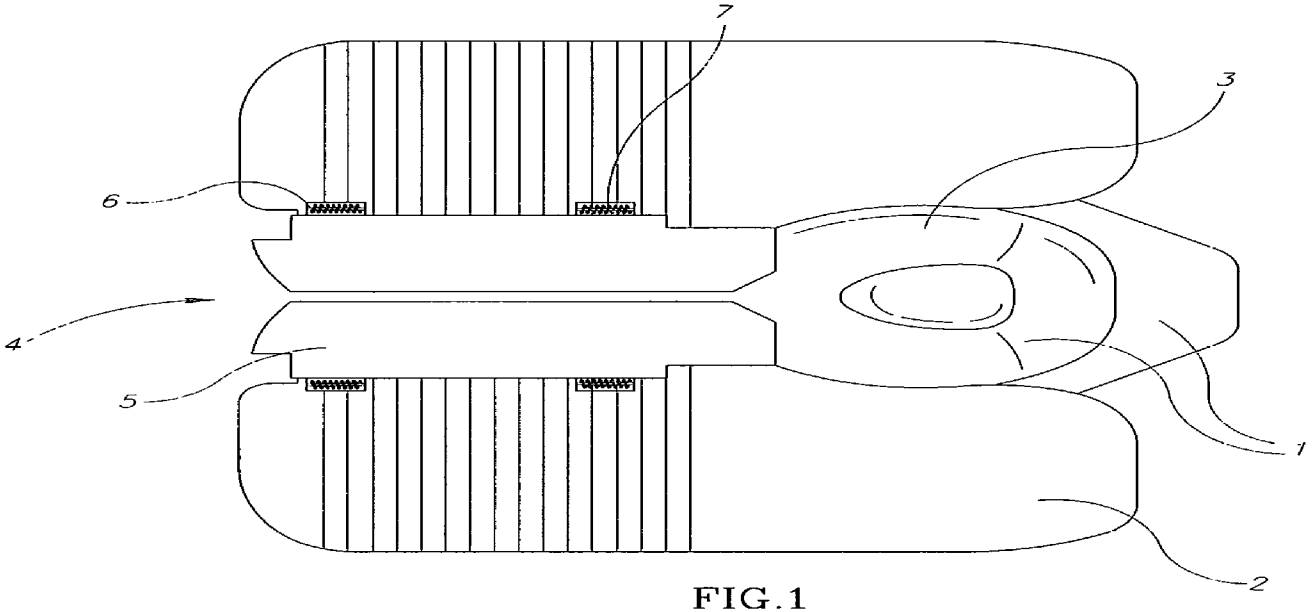
FIG. 1 demonstrate the device with general view from above

Referring to FIG. 1-5 there is shown a combined toilet device for mounting over a toilet bowl (1). The device comprises a platform (2) having an opening (3) aligned with the opening of the toilet bowl. The platform constructed in a planner shape for supporting of a user in a squatting posture over said opening. The device includes a urinal pan (up), which is shown in a functional position in FIG. 2. As is well known the urinary sphincter is opened refectory after defecation and urine is discharged. The urinal pan prevent dispersion of urine and soiling of the platform and legs and clothes of the user. The urinal pan when in a nonfunctional horizontal position occupy the middle part of the platform from the opening to the front edge of the platform. In FIG. 1 the urinal pan is in a nonfunctional horizontal position, the pan is not seen as it is hidden by the cover 4.

Figure 2:
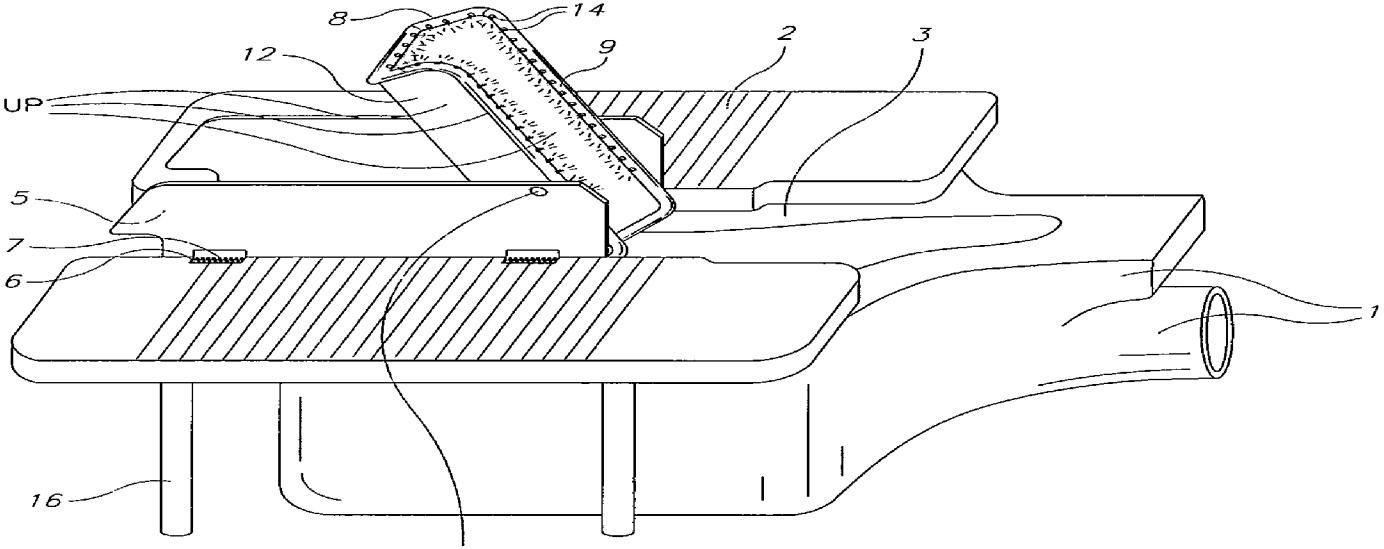
FIG. 2 demonstrate the device with urinal pan in a functional position
Figure 3:
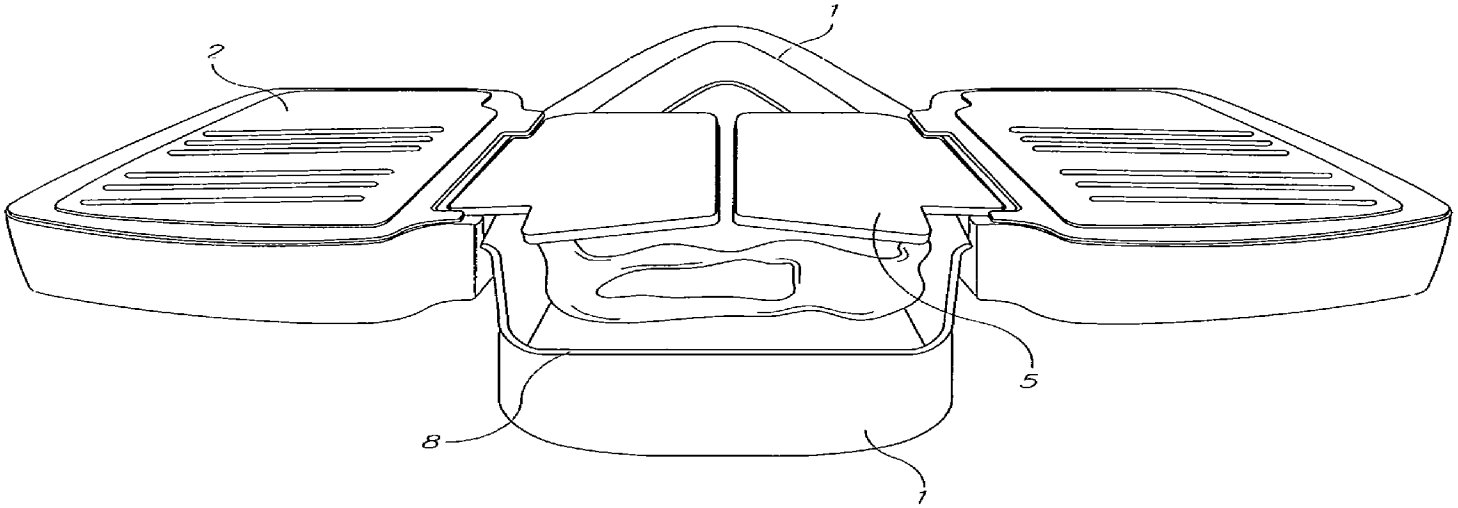
FIG. 3 demonstrate the front view

The aim of the cover is to prevent destruction of the urinal pan while the user rises on the squatting device for assuming of the squatting position. The cover is combined from two plastic leafs 5 as is shown in FIG. 1-3, which are cover the urinal pan in a nonfunctional position and are attached pivotally to the platform at either side of urinal pan by axles 6 as is illustrated FIG. 1-2. In the axles 6 are included springs 7. The leafs of the cover may be from firm plastic material strong enough to maintain the men's body.

Figure 4:
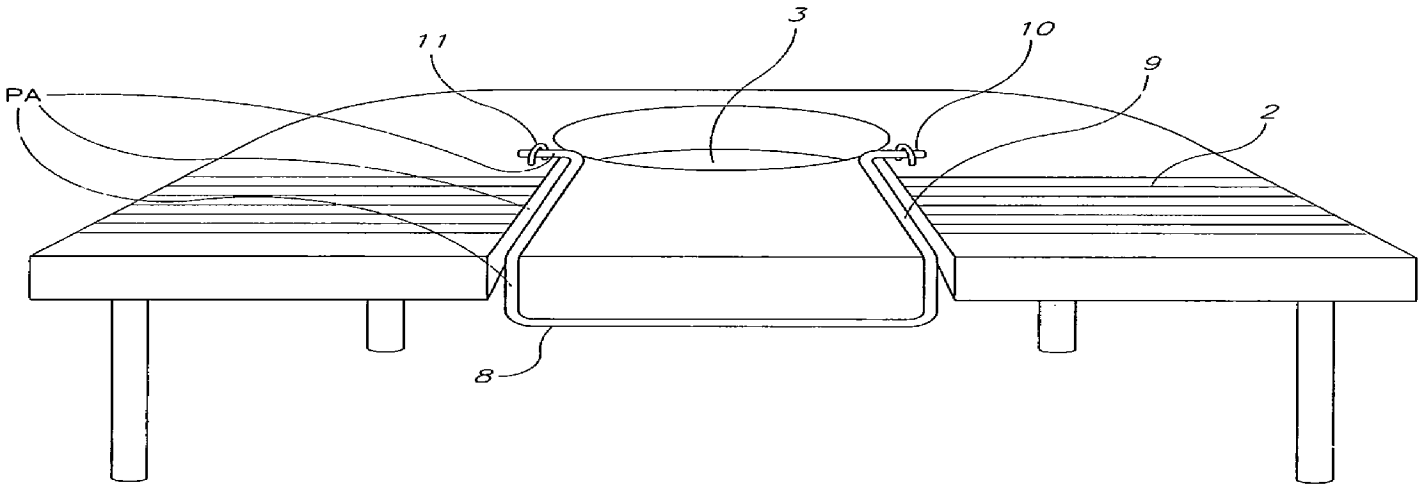
FIG. 4 demonstrate the device with partial view, it is illustrated only the pipe arc in a nonfunctional horizontal position. The flexible material of urinal bag and cover are not shown.

The frame of the urinal pan is formed by a pipe arc (pa), illustrated in partial view in FIG. 4, combined from two continuous parts, short (8) and long (9) one. In partial view in FIG. 4 pipe arc (pa) is in a nonfunctional position wherein the long part (9) of the pipe arc is in the horizontal plane and immediately beyond the front edge of the platform is bend by 90 grade downward thus forming the short part (8).

The short part 8 of the pipe arc serves as a handle for pivoting the urinal pan from folded nonfunctional as is in FIG. 3-4 to functional position as in FIG. 2. The user can lift the short part 8 and pull it in its direction. Pushing down the long part 9 of the pipe arc pivot the urinal pan from functional position as illustrated in FIG. 2 to nonfunctional position as is illustrated in FIG. 3-4.

FIG. 4 is a partial view showing only the pipe arc in a nonfunctional horizontal position. The both ends, the free ends 10 of the rear part of the pipe arc are bent outside with one or both of them attached to water source (not shown). Just at this bending both ends of the pipe arc are attached pivotally by a ring 11 to the platform in vicinity of front part of the opening 3.

As is shown in FIG. 2 a flexible material (12) is attached to external surface of pipe arc continuously on all length of long and short parts of the pipe arc forming a front, side and bottom walls of urinal pan thus creating a urinal bag opened in the direction of a squatting man. As the long and short portions of the pipe arc are in different planes with 90 grades between them just attaching of any flexible material to pipe arc will create folds preventing effective washing of walls interior of the pan. To overcome this obstacle it may be used materials such as silicone, rubber or similar materials that may form any desirable shape of urine bag by means of appropriate mold and then to fix to it to pipe arc.

As the long and short parts of the urinal pan are in different planes with 90 grade between them a depth is created in urinal bag as is illustrated in FIG. 2. That is, the front wall of urinary bag is faraway from the user thus preventing the urine stream rebounding on the user but at the same time permit to move the urinal pan as close as possible to the user's opening of the urethra. It is found in preliminary tests that dispersion of urine may be prevented only when the urinal pan is moved maximally close to urethral opening.

When the urinal pan is converted to functional position as is in FIG. 2 the leafs of the cover are pushed aside but the springs in the axles of leafs cause resistance by pressing on the pipe arc namely on the urinal pan and thus may fixate the pan at any desirable point, for example point 13 of specific user. The angle of the squatting posture of different persons is different and accordingly the necessary distance of urinal pan from body of specific user will be different. The user may move the pan to any desirable position while the pressure of cover leafs on urinal pan will ensure such position.

The pipe arc serves for leading water to wash the internal parts of the walls of the pan through nozzles 14 which are found continuously along short and long parts as illustrated in FIG. 2.

Thus the pipe arc fulfill several function: It is used as a frame to which attached flexible material for forming the urine walls, lead the water to wash the internal parts of walls from residual urine, pivot the urinal pan from nonfunctional to functional position and vice versa.

The cover as well fulfils several function. It prevent destruction of urinal pan when the squatting posture is assumed, the leafs of the cover can fixate the urinal pan at any desirable point, the cover is fulfill also esthetic role.

Figure 5:
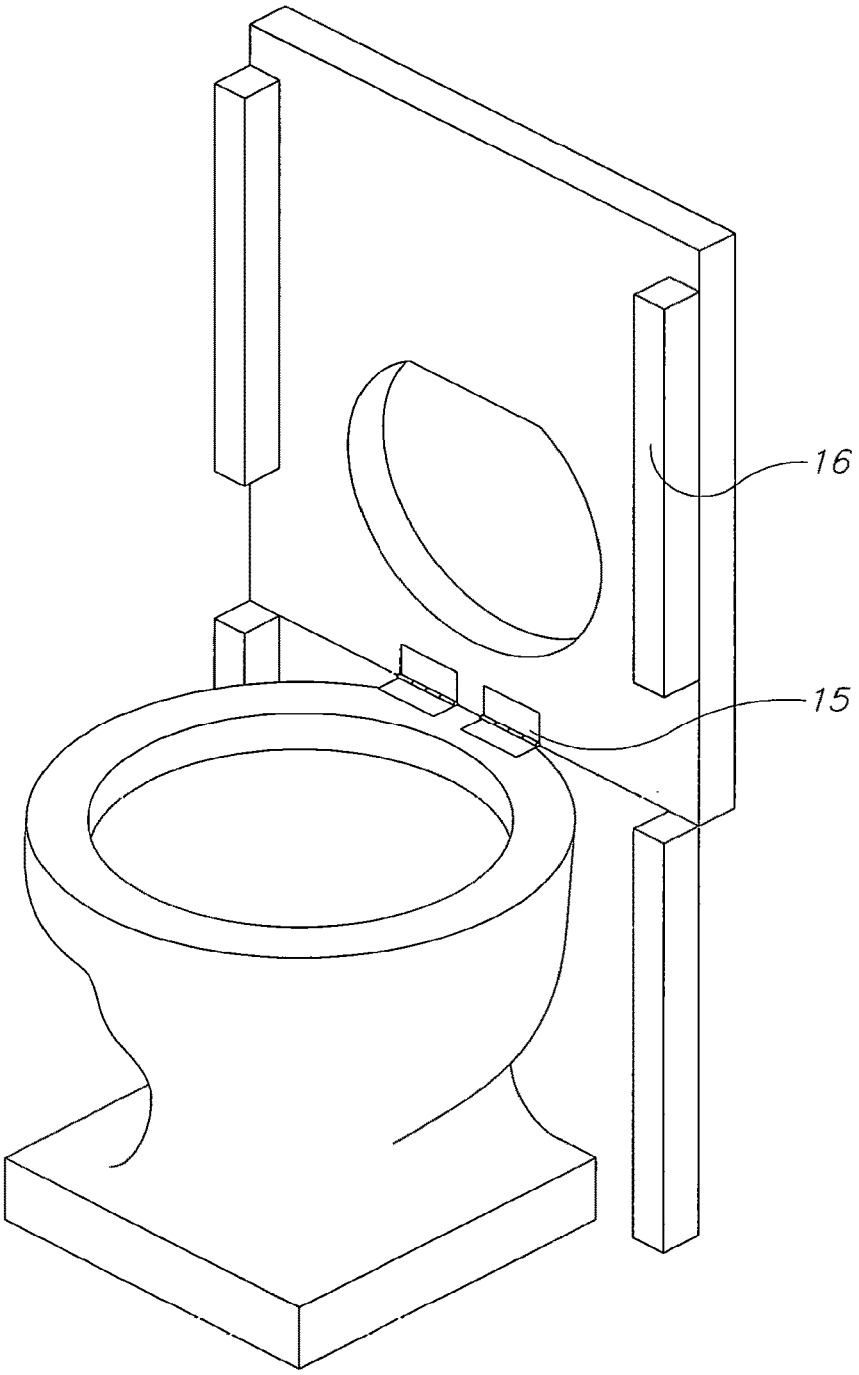
FIG. 5 illustrate the attaching of the platform to a toilet bowl

The platform mounted pivotally by hinges 15 as is shown in FIG. 5 to the rear part of the toilet bowl. Two or more legs 16 are fixed or attached pivotally to underneath of the platform as is shown in FIG. 2,4,5 for supporting the platform and the user on it.

The invention claimed is:

1. A combined toilet device for defecation in a natural squatting defecation posture and having a platform to support a user in the squatting defecation posture over its opening aligned with the toilet bowl;

said platform attached pivotally to rear part of the toilet bowl and includes legs which are fixed or pivotally mounted to its underneath to support the platform and user thereon;

said device comprises a urinal pan to prevent urine dispensing and occupies the middle part of the platform from its front edge to the opening;

said device includes a cover formed from two plastic leafs attached pivotally to the platform, one at either side of the pan to cover the pan in a nonfunctional position;

said urinal pan comprising a frame, formed from a pipe arc having long and short parts, which continue one into another; the long part of the pipe arc configured to bend by 90 degrees downward at the front of the platform thus forming the short part of the pipe arc;

said pipe arc is characterized in that the long and short parts are in different planes of 90 degrees between them;

said pipe arc is characterized in that the rear part of long part of the pipe arc is attached pivotally to the platform;

the urinal pan is characterized in that the material such as silicone or rubber is attached continuously to long and short parts of pipe arc thus forming walls of the urinal pan and creating an a urinal bag, opened in the direction of squatting man;

the different planes of long and short parts of pipe arc are characterized in that the different planes create a depth in the urinary bag configured to pivot the urinal pan close to user's urinary opening without fear from urine rebounding on squatting user;

wherein short and long parts of the pipe arc are configured to pivot the pipe arc namely of the urinal pan to functional or nonfunctional position;

wherein the pipe arc is a frame of the urinal pen, the pipe arc formed continuously into long and short parts, which are in different planes with 90 degrees between them.

2. The device accordingly to claim 1 wherein the long and short parts of the pipe arc are configured to pivot the urinal pan to functional or nonfunctional positions.

3. The device accordingly to claim 2 wherein the short part of the pipe arc serves as handle for pivoting of the pipe arc namely of the urinal pan to functional position.

4. The device accordingly to claim 3 wherein the handle that is the short part of the pipe arc can be pulled by the squatting user to himself thus easily pivoting the urinal pan to functional position.

5. The device accordingly to claim 2 wherein the pipe arc that is the urinal pan can be pivoted to nonfunctional position by pushing down on the long part of the pipe arc.

6. The device according to claim 1 wherein the walls of the urinal pan, forming the urinary bag, are made from silicone or rubber material, configured to create the urinary bag of desirable shape by appropriate mold.

7. A combined toilet device for defecation in a natural squatting defecation posture and having a platform to support a user in the squatting defecation posture over its opening aligned with the toilet bowl;

said platform attached pivotally to rear part of the toilet bowl and includes legs which are fixed or pivotally mounted to its underneath to support the platform and user thereon;

said device comprises a urinal pan to prevent urine dispensing and occupies the middle part of the platform from its front edge to the opening;

said device includes a cover formed from two plastic leafs attached pivotally to the platform, one at either side of the pan to cover the pan in a nonfunctional position;

said urinal pan comprising a frame, formed from a pipe arc having long and short parts, which continue one into another; the long part of the pipe arc configured to bend by 90 degrees downward at the front of the platform thus forming the short part of the pipe arc;

said pipe arc is characterized in that the long and short parts are in different planes of 90 degrees between them;

said pipe arc is characterized in that the rear part of long part of the pipe arc is attached pivotally to the platform;

the urinal pan is characterized in that the material such as silicone or rubber is attached continuously to long and short parts of pipe arc thus forming walls of the urinal pan and creating an a urinal bag, opened in the direction of squatting man;

the different planes of long and short parts of pipe arc are characterized in that the different planes create a depth in the urinary bag configured to pivot the urinal pan close to user's urinary opening without fear from urine rebounding on squatting user;

wherein short and long parts of the pipe arc are configured to pivot the pipe arc namely of the urinal pan to functional or nonfunctional position;

wherein different planes of 90 degrees between long and short parts of the pipe arc create a depth in the urinary bag, thus in the functional position of the pen its front wall is faraway from the user's urinary opening.

* * * * *